US007722097B2

(12) United States Patent
Schnarr et al.

(10) Patent No.: US 7,722,097 B2
(45) Date of Patent: May 25, 2010

(54) SURFACE MOUNTED ELECTRIC RIM STRIKES

(75) Inventors: Robert P. Schnarr, Cambridge (CA); John S. Rutherford, Cambridge (CA)

(73) Assignee: Rutherford Controls International Corp., Cambridge (Ontario) (CA)

( * ) Notice: Subject to any disclaimer, the term of this patent is extended or adjusted under 35 U.S.C. 154(b) by 0 days.

(21) Appl. No.: 11/353,074

(22) Filed: Feb. 14, 2006

(65) Prior Publication Data

US 2006/0192397 A1 Aug. 31, 2006

Related U.S. Application Data

(60) Provisional application No. 60/652,849, filed on Feb. 15, 2005.

(51) Int. Cl.
*E05B 15/02* (2006.01)

(52) U.S. Cl. ..... 292/341.16; 292/201; 292/341.18

(58) Field of Classification Search ..... 292/341.16, 292/341, 341.17, 341.18, 201
See application file for complete search history.

(56) References Cited

U.S. PATENT DOCUMENTS

| | | | | | |
|---|---|---|---|---|---|
| 526,909 | A * | 10/1894 | Pratt | 292/341.16 |
| 3,136,930 | A * | 6/1964 | Straub | 335/228 |
| 3,804,442 | A * | 4/1974 | Powers | 292/341.16 |
| RE30,263 | E * | 4/1980 | Horvath | 292/341.16 |
| 4,211,443 | A | 7/1980 | Butts et al. | |
| 4,613,176 | A | 9/1986 | Kelly | |
| 4,626,010 | A | 12/1986 | Hanchett et al. | |
| 4,756,566 | A | 7/1988 | Logas | |
| 4,917,425 | A | 4/1990 | Logas | |
| 4,984,835 | A * | 1/1991 | Vadacchino et al. | 292/341.16 |
| 4,986,584 | A * | 1/1991 | Logas | 292/341.16 |
| 5,076,625 | A | 12/1991 | Oxley | |
| 5,484,180 | A * | 1/1996 | Helmar | 292/341.16 |
| 5,934,720 | A * | 8/1999 | Karalius | 292/341.16 |
| 6,299,225 | B1 * | 10/2001 | Chang | 292/341.16 |
| 6,595,563 | B2 | 7/2003 | Kiernan | |
| 6,595,564 | B1 | 7/2003 | Hanchett et al. | |
| 6,634,685 | B2 * | 10/2003 | Herron et al. | 292/341.16 |
| 6,874,830 | B2 * | 4/2005 | Bashford | 292/341.16 |
| 6,926,318 | B2 | 8/2005 | Oxley | |
| 6,966,585 | B2 * | 11/2005 | Egi et al. | 292/341 |
| 7,273,241 | B2 * | 9/2007 | Milo | 292/341.15 |
| 2003/0127870 | A1 * | 7/2003 | Schildwachter et al. | 292/341.16 |
| 2004/0032130 | A1 * | 2/2004 | Oxley | 292/201 |
| 2004/0061343 | A1 * | 4/2004 | Bashford | 292/341.16 |

FOREIGN PATENT DOCUMENTS

| | | |
|---|---|---|
| GB | 2 364 742 | 2/2002 |
| WO | 93/06325 | 4/1993 |
| WO | 2004/015231 | 2/2004 |

* cited by examiner

*Primary Examiner*—Peter M Cuomo
*Assistant Examiner*—Kristina R Fulton
(74) *Attorney, Agent, or Firm*—Baker & Hostetler LLP

(57) ABSTRACT

An electric rim strike including a housing having a cavity defined therein; a pivotally rotatable keeper having a front blocking face; a pivotally rotatable locking bar having a rear blocking face; and an actuating mechanism that selectively pivots the locking bar. The keeper, locking bar, and actuating mechanism are disposed within the cavity of the housing. The actuating mechanism being operationally connected to the locking bar and driving the locking bar and the keeper from a first state to a second state. The rear blocking face of the locking bar opposes the front blocking face of the keeper to prevent the locking bar and keeper from freely rotating relative to each other.

21 Claims, 12 Drawing Sheets

SURFACE MOUNTED ELECTRIC RIM STRIKES

CROSS-REFERENCE TO RELATED APPLICATION

This application claims priority from U.S. Provisional Patent Application Ser. No. 60/652,849 of Oxley et al., filed Feb. 15, 2005, titled Electric rim strikes, the entirety of which is incorporated herein by reference.

BACKGROUND OF THE INVENTION

1. Field of the Invention

The field of the invention relates generally to electric rim strikes. In particular, the present invention relates to electric rim strikes that include a keeper, a first blocking element configured to move substantially in a first plane and to selectively prevent and allow a rotation of the keeper, and a second blocking element, at least an end portion of which is configured to move substantially in a second plane that intersects the first plane and to selectively prevent and allow the movement of the first blocking element in the first plane.

The present invention also relates to electric rim strikes that include a keeper having a first axial shaft about which to rotate; a locking bar having a second axial shaft about which to rotate; and an actuating mechanism having at least one solenoid and an anchor for the at least one solenoid. The actuating mechanism is operationally connected to the locking bar and drives the locking bar and the keeper from a first state to a second state. The rear blocking face of the locking bar opposes the front blocking face of the keeper across a gap defined therebetween, the gap being sized and the blocking faces of the locking bar and keeper being configured to prevent the locking bar and keeper from freely rotating relative to each other.

2. Description of Related Art

Electric rim strikes for securing hinged or swinging doors are known in the field of door security systems. A known electric rim strike generally is employed with a door having an extendable latch bolt that engages the electric rim strike, and the electric rim strike may be configured to secure the door alone or may be used in combination with other known security systems to secure the door. The known electric rim strike generally is mounted to the doorframe and defines an opening in the jam face of the doorframe for receiving the latch bolt from the lockset mounted to the door.

The known electric rim strike also defines an opening in the frame face contiguous with the opening in the jam face of the doorframe. The known electric rim strike includes a pivotable keeper that selectively closes the opening in the frame face, and a bolt projecting from the edge of the door engages the electric rim strike through the opening in the jam face. The known electric rim strike also includes a blocking element that selectively prevents the keeper from rotating and allows the keeper to rotate, and a solenoid that selectively moves the blocking element from a first position, in which the blocking element prevents the rotation of the keeper, to a second position, in which the blocking element allows the rotation of the keeper, and vice versa.

Specifically, when the keeper rotates, the keeper uncovers or opens the frame face opening, which allows the bolt to freely move through the opening, and thereby allows the door to be opened.

Nevertheless, in such known electric rim strikes, portions of the electric rim strike may protrude into the door frame, and the door frame may have to be cut during installation of the electric rim strike to accommodate those portions of the electric rim strike that protrude or extend into the door frame, which increases the difficulty of installing the electric rim strike. Moreover, a size of known electric rim strikes that do not include such protruding portions may increase the cost of manufacturing the electric rim strike.

It should be noted that such electric rim strikes are a commonly required safety feature in such establishments as hospitals, move theaters, and the like wherein doors incorporating such a feature must be readily and easily opened, while at the same time maintained in a securely closed state when there is no need to be open.

SUMMARY OF THE INVENTION

Therefore, a need had arisen for electric rim strikes which overcome these and other shortcomings of the related art. Technical advantages of the present invention include that the electric rim strike may not include portions that protrude into the door frame, and the electric rim strike is compact and cost efficient to manufacture.

In a first embodiment of the present invention, an electric rim strike comprises a keeper, a first blocking element, e.g., a locking plate, configured to move substantially within a first plane and to selectively prevent and allow a rotation of the keeper, and a second blocking element, e.g., an anchor, at least an end portion of which is configured to move within a second plane and to selectively prevent and allow a movement of the first blocking element. Specifically, the first plane intersects the second plane, e.g., the first plane may be substantially perpendicular to the second plane.

For example, when at least the end portion of the second blocking element is substantially aligned with at least an end portion of the first blocking element at the intersection of the first plane and the second plane, the second blocking element may prevent the movement of the first blocking element within the first plane and the first blocking element may prevent the rotation of the keeper. However, when the second blocking element is substantially unaligned with the first blocking element, the second blocking element may allow the movement of the first blocking element within the first plane and the first blocking element may allow the rotation of the keeper.

In a second embodiment of the present invention, an electric rim strike comprises a first blocking element e.g., a locking plate, configured to selectively prevent and allow a rotation of a keeper, and a second blocking element, e.g., an anchor, configured selectively to prevent and allow a movement of the first blocking element. The electric rim strike also comprises a feature or features for moving at least an end portion of the second blocking element, e.g., at least one solenoid. Specifically, a direction of the movement of the first blocking element is different than a direction of a force generated by the feature or features for moving at least the end portion of the second blocking element. For example, the direction of the movement of the first blocking element may be substantially perpendicular to the direction of the force generated by the feature or features for moving at least the end portion of the second blocking element.

In a third embodiment of the present invention, an electric rim strike comprises a housing, a keeper arranged in the housing, and a first blocking element, e.g., a locking plate, arranged in the housing, which is configured to selectively prevent and allow a rotation of the keeper. The electric rim strike also comprises a second blocking element, e.g., an anchor, arranged in the housing, which is configured to selectively prevent and allow a movement of the first blocking element, and a feature or features for moving at least an end portion of the second blocking element, e.g., at least one solenoid, from a first position to a second position. Specifically, when at least the end portion of the second blocking element is in the first position, the second blocking element prevents the movement of the first blocking element and the first blocking element prevents the rotation of the keeper, and when at least the end portion of the second blocking element is in the second position, the second blocking element allows the movement of the first blocking element and the first blocking element allows the rotation of the keeper. For example, the first blocking element may be configured to move substantially in a first plane, and at least the end portion of the second blocking element may be configured to move substantially in a second plane that intersects the first plane, e.g., that is substantially perpendicular to the first plane.

In a fourth embodiment of the present invention, an electric rim strike comprises a pivotable keeper having a front blocking face, the keeper being pivotally rotatable about a first pivot point, which may be, for example, an axial shaft, a pin, or any other such pivotable mechanism. The electric rim strike also comprises a pivotable locking bar having a rear blocking face, the locking bar being pivotally rotatable about a second pivot point, which may be, for example, an axial shaft, a pin, or any other such pivotable mechanism. The rear blocking face of the locking bar opposes the front blocking face of the keeper. The blocking faces of the locking bar and keeper are configured to prevent the locking bar and keeper from freely rotating relative to each other.

In a fifth embodiment of the present invention, an electric rim strike includes a housing having a cavity defined therein. A pivotable keeper, which has a front blocking face, the keeper being pivotally rotatable about a first pivot point, which may be, for example, an axial shaft, a pin, or any other such pivotable mechanism. A pivotable locking bar, which includes a rear blocking face, the locking bar being pivotally rotatable about a second pivot point, which may be, for example, an axial shaft, a pin, or any other such pivotable mechanism. An actuating mechanism includes at least one solenoid and an anchor for the at least one solenoid, the anchor being pivotally secured to the housing, wherein the keeper, locking bar, and actuating mechanism are disposed within the cavity of the housing. The at least one solenoid and the anchor are operationally connected to the locking bar, wherein the actuating mechanism drives the locking bar and the keeper from a first state to a second state.

Preferably, the locking bar includes a front face to which the rear blocking face of the locking bar extends oblique relative thereto. In one embodiment, the front blocking face of the keeper is parallel to the rear blocking face of the locking bar. The locking bar also includes a pair of arms and a member extending therefrom. At least one arm of the pair of arms includes the rear blocking face, which extends oblique relative to the front face of the member. The at least one arm of the locking bar includes the pivotable mechanism.

Preferably, the keeper also includes a first member, and a second member extending orthogonally relative to the first member. The first member includes a front face connected to the front blocking face of the keeper, the front blocking face extending obliquely relative to the front face of the first member. A front end of the first member of the keeper may include a first aperture configured to receive a biasing member retaining structure.

In an embodiment of the present invention, the locking bar and keeper are pivotally movable between a first state and a second state.

In one embodiment, in the first state, the blocking faces of the locking bar and the keeper abuttingly engage each other, thereby preventing the keeper and the locking bar from freely rotating. In the second state, the blocking faces of the locking bar and the keeper are prevented from abutting each other, thereby permitting the keeper and the locking bar to freely rotate. Further, the biasing member of the keeper and a biasing member of the locking bar urge the keeper and locking bar, respectively, back to the first state from the second state.

In yet another embodiment, in the first state, the blocking faces of the locking bar and the keeper are prevented from abutting each other, thereby permitting the keeper and the locking bar to freely rotate about their respective pivoting mechanism. In the second state, the blocking faces of the locking bar and the keeper abuttingly engage each other, thereby preventing the keeper and the locking bar from freely rotating. Further, the biasing member of the keeper and a biasing member of the locking bar urge the keeper and locking bar, respectively, back to the first state from the second state.

Other objects, features, and advantages of the present invention will be apparent to persons of ordinary skill in the art from the following detailed description of the invention and the accompanying drawings.

BRIEF DESCRIPTION OF THE DRAWINGS

For a more complete understanding of the present invention, the needs satisfied thereby, and the objects, features, and advantages thereof, reference now is made to the following description taken in connection with the accompanying drawings.

FIG. 10(*b*) is a schematic diagram of a front view of the relationship shown in FIG. 10(*a*);

FIG. 10(*c*) is a side view illustrating the gap defined by the blocking faces of the locking bar and keeper;

FIG. 12(*b*) is a schematic diagram of a front view of the relationship shown in FIG. 12(*a*);

FIG. 12(*c*) is a schematic diagram illustrating how the locking bar pivots when the actuating mechanism is energized and stops supporting the locking bar;

DETAILED DESCRIPTION OF PREFERRED EMBODIMENTS

Figure 1:
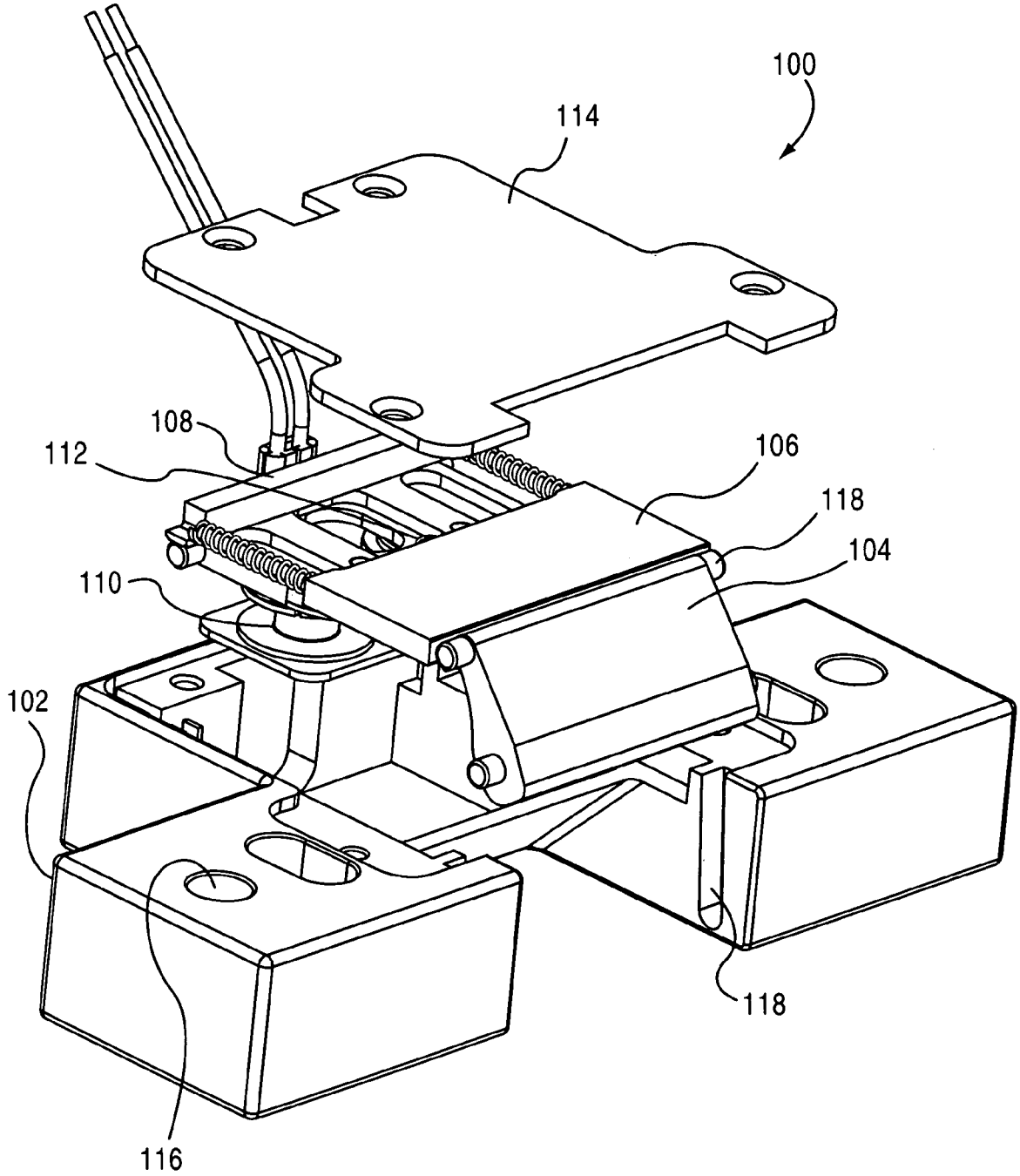
FIG. 1 is an expanded, perspective view of an electric rim strike according to an embodiment of the present invention.
Figure 2:
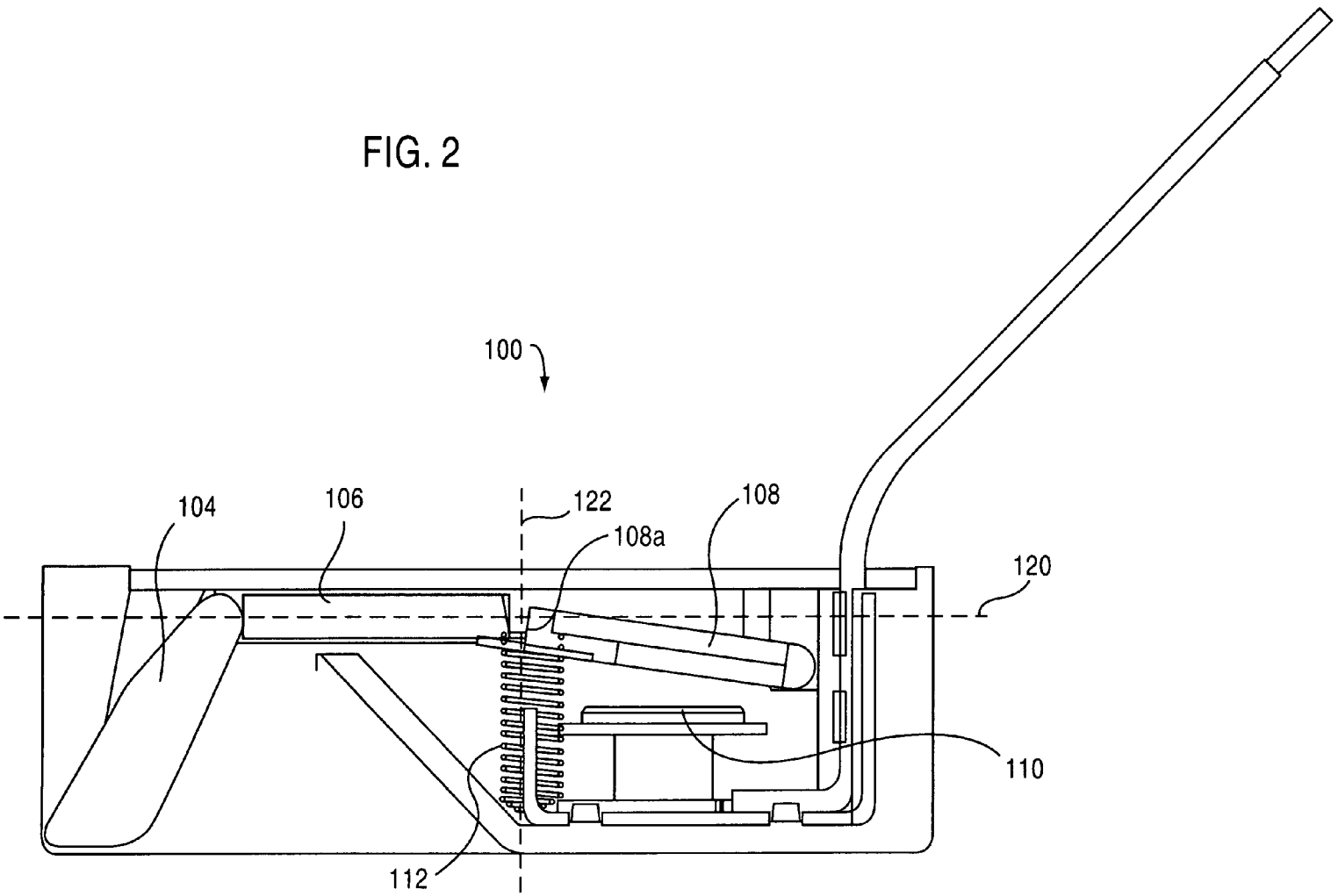
FIG. 2 is a cross-sectional view of the electric rim strike of FIG. 1, in which a keeper of the electric rim strike is prevented from rotating, thereby preventing a door from opening.
Figure 3:
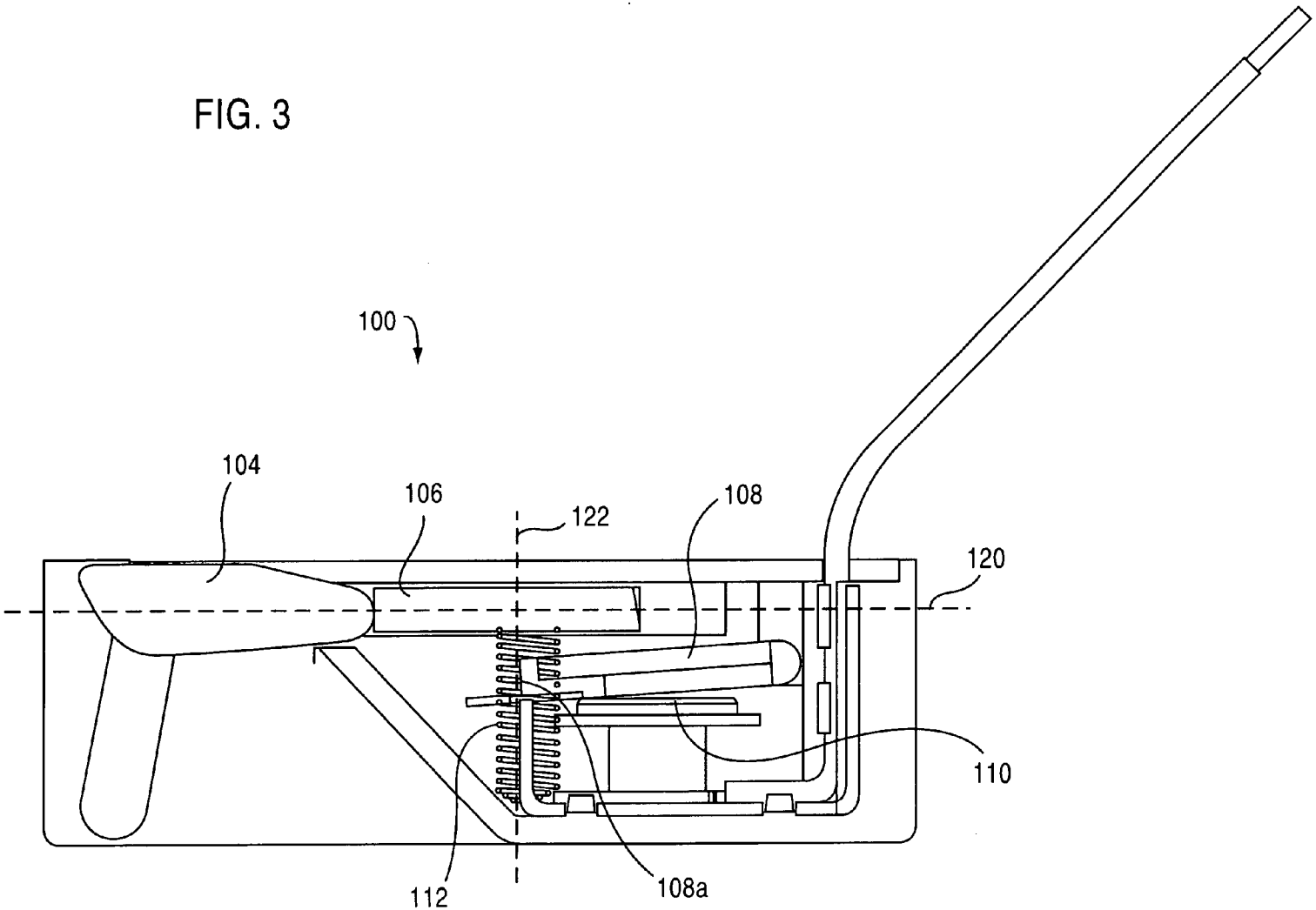
FIG. 3 is a cross-sectional view of the electric rim strike of FIG. 1, in which the keeper is allowed to rotate, thereby allowing the door to be opened.

A first embodiment of the present invention and the features and advantages thereto may be understood by referring to FIGS. 1-3, like numerals being used for like corresponding parts in the various drawings.

Referring to FIGS. 1-3, an electric rim strike 100, e.g., an electric rim strike configured to be surface mounted to a door frame (not shown), according to an embodiment of the present invention is depicted. Electric rim strike 100 may comprise a housing 102, a keeper 104 arranged in housing 102, a first blocking element 106, e.g., a locking plate, arranged in housing 102 and configured to selectively prevent and allow a rotation of keeper 104, and a second blocking element 108, e.g., an anchor, arranged in housing 102 and configured to selectively prevent and allow a movement, e.g. a sliding movement, of first blocking element 106. Electric rim strike 100 also may comprise means for moving at least an end 108*a* of second blocking element 108, e.g., at least one solenoid 110, arranged in housing 102, and means for biasing at least end 108*a* of second blocking element 108 in a predetermined position, e.g., at least one spring 112, arranged in housing 102. Moreover, electric rim strike 100 may comprises a cover plate 114 configured to enclose each of keeper 104, first blocking element 106, second blocking element 108, the at least one solenoid 110, and the at least one spring 112 within housing 102. Further, electric rim strike 100 may be configured to be surface mounted to the door frame by inserting a plurality of securing means (not shown), e.g., a plurality of screws, into a corresponding one of a plurality of openings 116 formed through housing 102.

For example, referring to FIG. 2, keeper 104 may be pivotally arranged within housing 102, such that keeper 104 is configured to rotate within housing 102. First blocking element 106 may be slidably arranged within housing 102, and a first end of first blocking element 106 may abut an end of keeper 104. Second blocking element 108 may be pivotally arranged within housing 102, and end 108*a* of second blocking element 108 may abut a second end of first blocking element 106, which is opposite the first end of first blocking element 106. Specifically, at least end 108*a* of second blocking element 108 may be substantially aligned with and substantially in the same plane as at least the second end of first blocking element 106 in order to prevent a sliding movement of first blocking element 106.

Moreover, the at least one spring 112 may be positioned within housing 102 to apply a first predetermined amount of force in a first direction to second blocking element 108. For example, the at least one spring 112 may be positioned below second blocking element 108, and an end of the at least one spring 112 may abut against and may apply the first predetermined amount of force to a surface of second blocking element 108. The first predetermined amount of force may be an amount of force which biases at least end 108*a* of second blocking element 108 to be substantially aligned with and substantially in the same plane as at least the second end of first blocking element 106 when no other force or substantially no other force acts on second blocking element 108. Further, the at least one solenoid 110 may be positioned within housing 102, such that when the at least one solenoid 110 is in an active state, the at least one solenoid 110 is configured to apply a second predetermined amount of force in a second direction opposite the first direction to second blocking element 108. For example, the at least one solenoid 110 may be positioned below second blocking element 108, and the second predetermined amount of force may be greater than the first predetermined amount of force, such that when the at least one solenoid 110 is in an active state, at least end 108*a* of second blocking element 108 is drawn toward the at least one solenoid 110 by the second predetermined amount of force. For example, when the at least one solenoid 110 transitions from an inactive state to an active state, second blocking element 108 may pivot, such that at least end 108*a* is drawn toward the at least one solenoid 110 (in this configuration, the end of second blocking element 108 that is opposite end 108*a* may move away from solenoid 110).

Referring to FIG. 2, in operation, when the at least one solenoid 110 is in an inactive state, the at least one spring 112 biases at least end 108*a* of second blocking element 108 to be in a first position within a first plane, e.g., to be substantially aligned with and substantially in the same plane as at least the second end of first blocking element 106. Consequently, when a person attempts to open a door associated electric rim strike 100, keeper 104 applies a force to first blocking element 106, however, second blocking element 108 prevents first blocking element 106 from moving, first blocking element 106 prevents keeper 104 from rotating, and the door cannot be opened.

Referring to FIG. 3, when the at least one solenoid 110 transitions from an inactive state to an active state, the at least one solenoid 110 applies the second predetermined force, e.g., a drawing force, to at least end 108*a* of second blocking element 108. The second predetermined force moves, e.g., pivots, second blocking element 108, such that at least end 108*a* of second blocking element 108 moves from the first position within the first plane to a second position within the first plane, e.g., a position in which second blocking element 108 is not aligned with and is not in the same plane as first blocking element 106. Moreover, when a person attempts to open a door associated with electric rim strike 100 after at least end 108*a* of second blocking element 108 moves to the second position within the first plane, keeper 104 begins to rotate in an inward direction and applies a force to first blocking element 106, which causes first blocking element 106 to move, e.g., slide, inward from a first position within a second plane, e.g., a position in which the first end of first blocking element 106 abuts an end of keeper 104, to a second position within the second plane, e.g., a position which allows keeper 104 to rotate inward. For example, the second plane may intersect the first plane, e.g., the second plane may be substantially perpendicular to the first plane, such that the direction of movement of first blocking element 106 is substantially perpendicular to each of the direction of movement of at least end 108*a* of second blocking element 108 and the direction of the second predetermined force.

Keeper 104 then may continue to rotate until keeper 104 is in a predetermined position that allows the door to be opened. For example, keeper 104 may comprises a plurality of pin members 118, and housing 102 may comprise a plurality of channels (not shown), each of which is configured to receive a corresponding one of pin members 118. When keeper 104 rotates, at least one of pin members 118 may move from a first end of its corresponding channel to a second end of its corresponding channel, and when the at least one pin member 118 reaches the second end of its corresponding channel, the corresponding channel may prevent keeper 104 from rotating any further. Moreover, when the door closes, keeper 104 may rotate outward to its original position, and because keeper 104 no longer is applying a force to first blocking element 106, first blocking element 106 may move from the second position within the second plane to the first position within the second plane. Further, when the at least one solenoid 110 transitions from an active state to an inactive state, at least end 108*a* of second blocking element 108 may move from the second position within the first plane to the first position within the first plane, such that electric rim strike 100 returns to the configuration depicted in FIG. 2. This pattern may be repeated every time that the at least one solenoid 110 transitions from an inactive state to an active state.

A second embodiment of the present invention, the features and advantages thereof, will be understood by referring to FIGS. 4-14, wherein like numerals are used for like corresponding parts in the various drawings.

Figure 4:
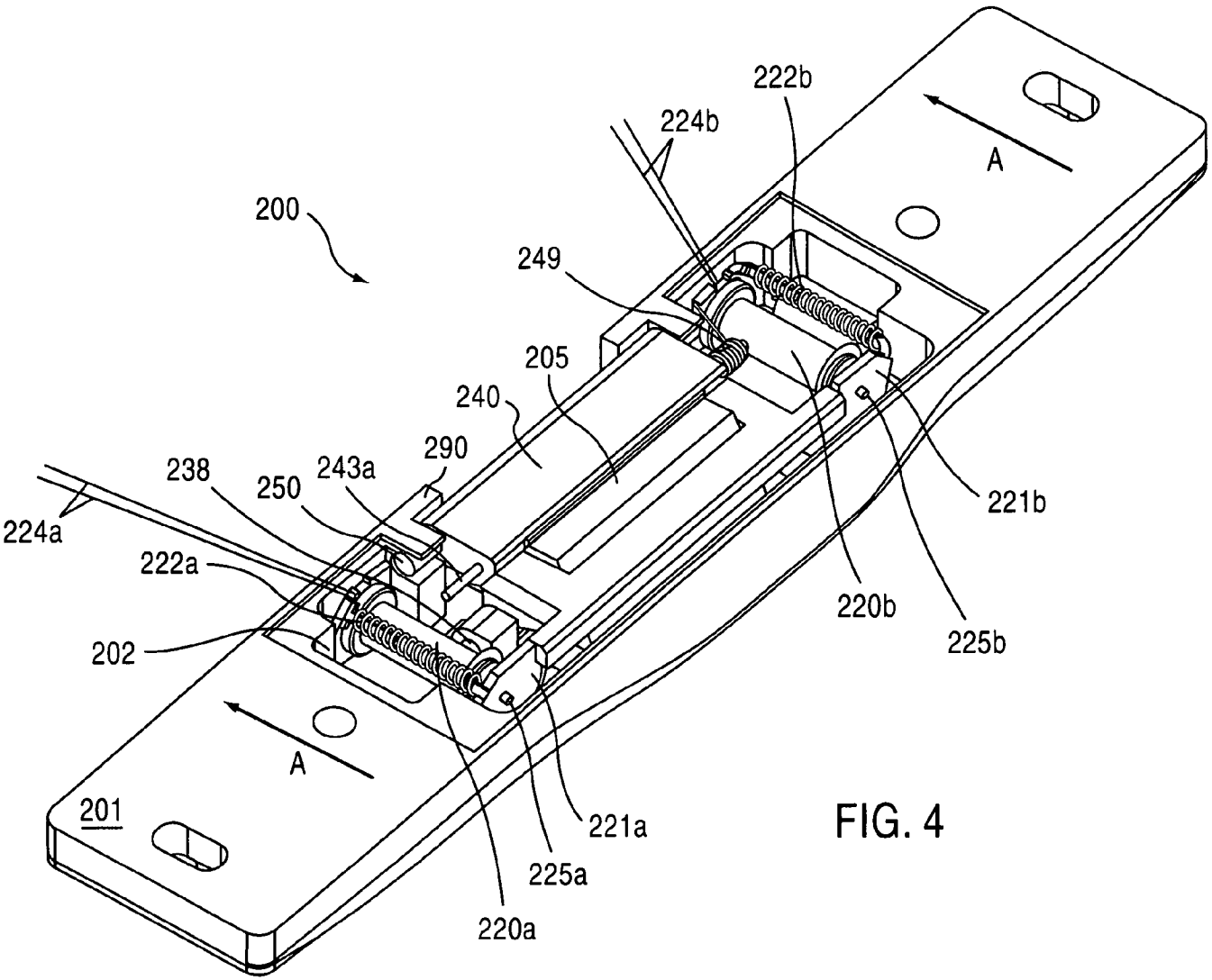
FIG. 4 is a perspective view of an electric rim strike according to a second embodiment of the present invention.

Referring to FIG. 4, a perspective view of a second embodiment of a surface mounted electric rim strike 200 is shown. In general, the rim strike 200 includes an actuating mechanism, which in the shown embodiment is a pair of solenoids 220*a*, 220*b* and corresponding anchors 221*a*, 221*b*; a pivotally rotatable locking bar 230; and a pivotally rotatable keeper 240.

Figure 5:
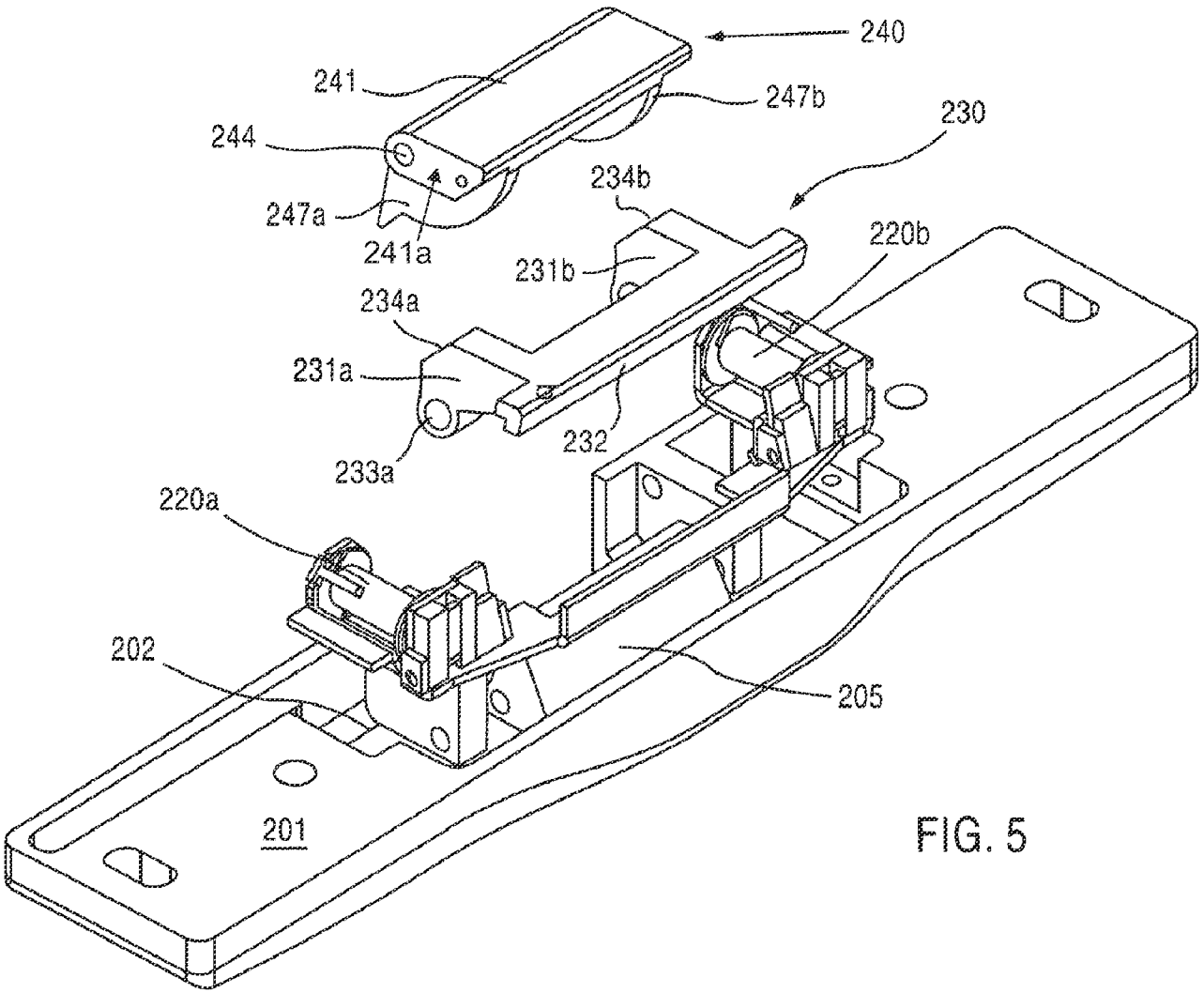
FIG. 5 is an exploded view of the electric rim strike illustrated in FIG. 4.

FIG. 5 is an exploded view of an embodiment of the rim strike 200 intended to illustrate the structural arrangement of the actuating mechanism, i.e., solenoids 220*a*, 220*b* and anchors, 221*a*, 221*b*, locking bar 230 and keeper 240, relative to each other. The rim strike 200 includes a housing 201 having a cavity 202 defined therein, which is configured to receive the solenoids 220*a*, 220*b* and anchors 221*a*, 221*b* therein, respectively. The solenoids 220*a*, 220*b* and anchors 221*a*, 221*b* are operationally connected to the locking bar 230, which operationally abuts the keeper 240. It should be noted that in FIG. 5, the locking bar 230 and keeper 240 are shown without their respective pivoting mechanisms, such as, for example, an axial shaft or a pin.

Figure 6:
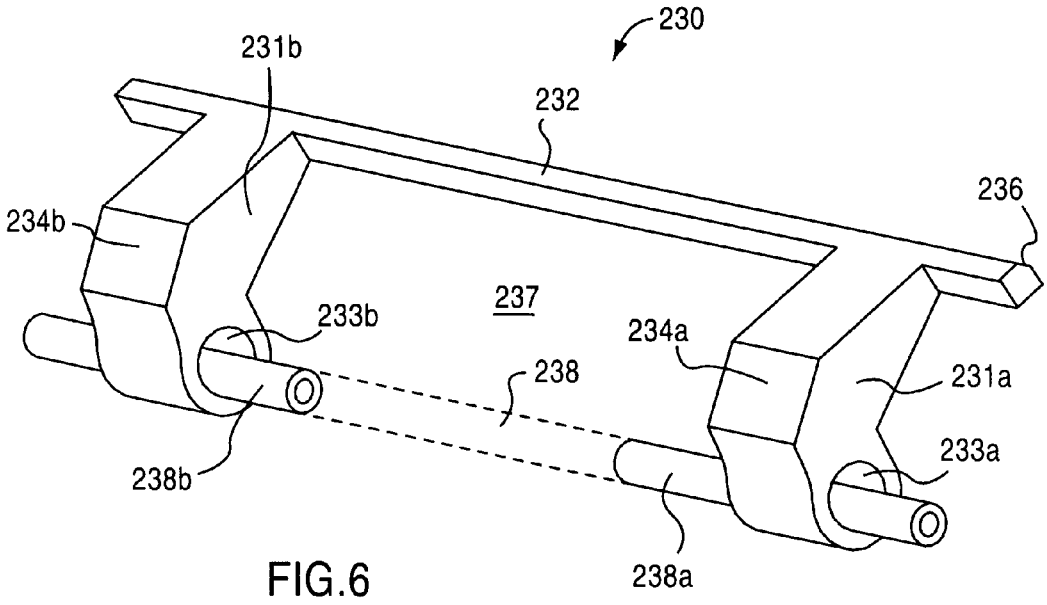
FIG. 6 is a perspective view of a locking bar.
Figure 7:
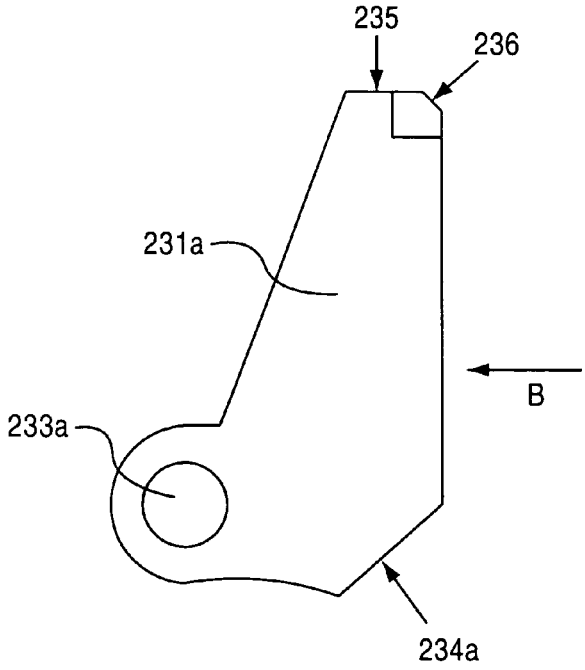
FIG. 7 is a side view of the locking bar.
Figure 8:
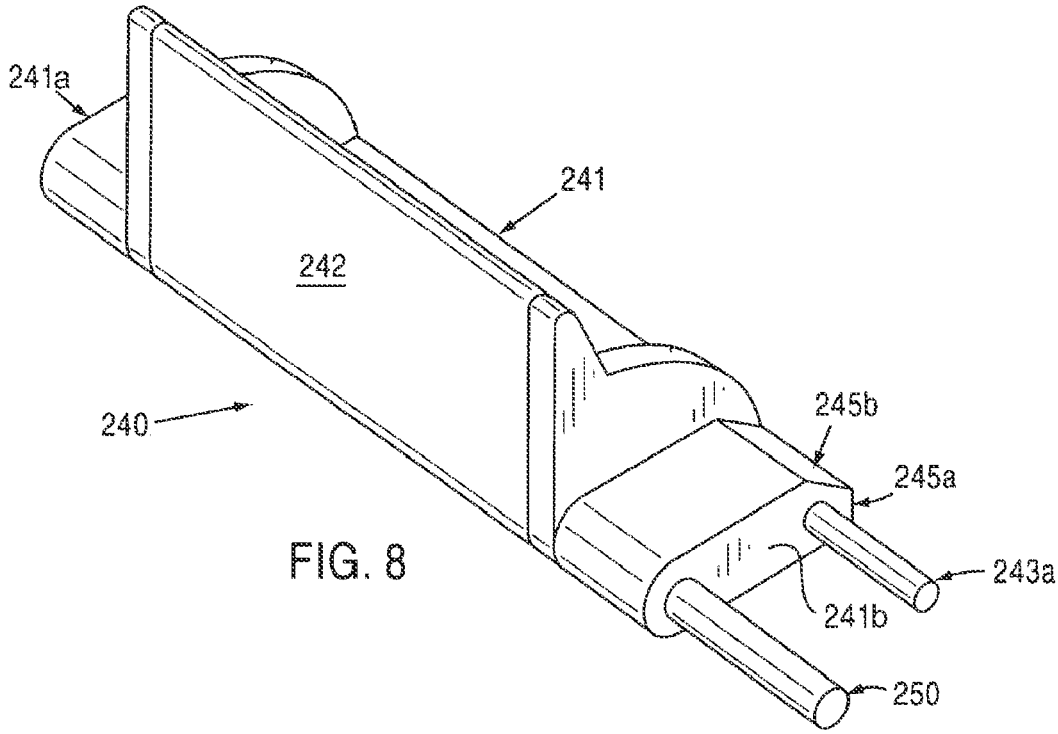
FIG. 8 is a perspective view of a keeper.
Figure 9:
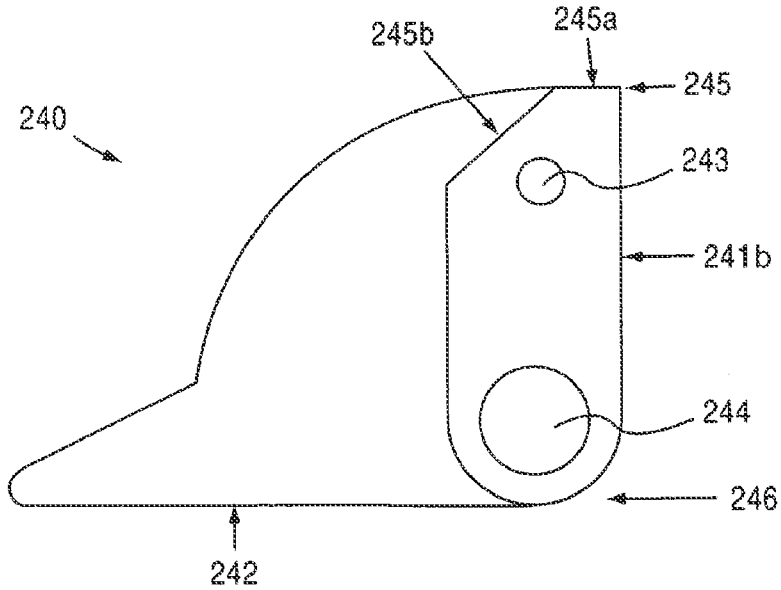
FIG. 9 is a side view of the keeper.

As shown in FIG. 6, the locking bar 230 includes a member 232 connected to a pair of extension arms 231*a* and 231*b*. A cross-sectional view of the locking bar 230 shown in FIG. 7 illustrates that the member 232 includes a front face 235 connected to an upper face bevel portion 236, which is oblique relative thereto. Furthermore, each arm 231*a* and 231*b* includes a rear blocking face 234*a* and 234*b* that is also oblique relative to the front face 235 of the member 232.

When viewed from direction B, as shown in FIG. 7, the member 232 and arms 231*a* and 231*b* extending from the member 232 define a space 237 (FIG. 6) configured to receive the back face 205 of the housing 201 (See FIGS. 4 and 5) therein. Preferably, the locking bar 230 is manufactured from a suitable material, such as, steel or any other suitable metal, as well as an alloy, such as an alloy containing aluminum. However, it should be noted that the locking bar 230 can be manufactured from any suitable material now known or later developed that will provide the requisite durability and strength required to allow the door in which the rim strike 200 is mounted to properly function, i.e., repeatedly open and close.

In an embodiment of the present invention in which the pivoting mechanism is an axial shaft, each arm 231*a* and 231*b* includes an aperture or through-hole 233*a* and 233*b*, respectively, that is configured to receive an axle 238 therein (See FIGS. 4 and 6). As such, the locking bar 230 is able to pivotally rotate about the axle 238 when the solenoid 220*a* or 220*b* is energized, as will be explained in further detail below. However, it should be noted that it is within the scope of the present invention to provide pins 238*a*, 238*b* for the locking bar 230 to pivotally rotate around instead of the axle 238 or any other such axial shaft.

Referring to FIG. 4, the keeper 240 is in an abutting relationship with the locking bar 230. The keeper 240 includes a first member 241 that has an end 241*a* and an end 241*b* (See FIGS. 8 and 9), and a second member 242, that extends orthogonally relative to the first member 241. A first end portion 245 of the first member end 241*b* includes a front face 245*a* connected to a front blocking face 245*b*, which is oblique relative thereto (See FIG. 9); and a first aperture 243 configured to receive a biasing member retaining structure, such as a dowel, 243*a* therein. As will be explained below, the rear blocking face 234*a* and 234*b* of the locking bar 230 abuts against the front blocking face 245*b* of the keeper 240. A biasing member 249 (See FIG. 4), such as a spring, is disposed about the dowel 243*a* to bias the keeper 240 to a predetermined state. A second end portion 246 opposite the first end portion 245 of the first member end 241*b* includes an aperture or through-hole 244 formed therein to receive an axle 250. The axle 250 of the keeper 240 is rotatably retained between the housing 201 and a faceplate 290 (See FIG. 4). First member end 241*a* is similarly configured (See FIG. 5). However, it should be noted that it is within the scope of the present invention to provide a pin about which the keeper 240 may pivotally rotate instead of the axle 250 or any other such axial shaft.

It should be noted that although the above and following discussions of the rim strike 200 include a pair of solenoids 220*a*, 220*b*, it is within the scope of the present invention to have an actuating mechanism with only one solenoid and a corresponding, single anchor. Likewise, it is also within the scope of the present invention to provide the actuating mechanism with two or more solenoids and corresponding anchors. As such, it should readily be apparent that the actuating mechanism requires at least one solenoid and corresponding anchor to operate the rim strike 200 in a manner that will be described in further detail below.

Returning to FIG. 4, it can be seen that each solenoid and anchor pair 220*a*, 221*a* and 220*b*, 221*b* includes a corresponding energizing spring or coil 222*a* and 222*b*, respectively. Also, a pair of wires or other electrical connecting feature 224*a* and 224*b* is connected to a corresponding one of the solenoids 220*a* and 220*b*, respectively. The wires or connectors 224*a* and 224*b* are electrically coupled to a power source (not shown). As such, in operation, when a current passes from the power source, through the connectors 224*a* and 224*b*, to the solenoids or other thrust mechanisms 220*a* and 220*b*, the thrust mechanisms 220*a* and 220*b* receive the current, and the locking bar 230 is disengaged by the anchors 221*a* and 221*b*.

For example, if the thrust mechanism 220*a* and 220*b* is a pair of solenoids, it should be noted that spacers 225*a* and 225*b* are preferably manufactured from a non-magnetic material and used to maintain an air gap between the core of each solenoid 220*a* and 220*b* and corresponding anchors or armatures 221*a* and 221*b* in order to decrease the amount of any residual magnetism and sticking of the armature 221*a* and 221*b* to the solenoid core. For example, when the solenoids 220*a* and 220*b* receive a current, the solenoids 220*a* and 220*b* are driven in a direction indicated by the arrow A in FIG. 4. Because the spacers 225*a* and 225*b* are operationally connected to a corresponding anchor or armature 221 and 221*b*, each anchor 221*a* and 221*b* pivots in a direction indicated by the arrow 223 (FIG. 12(*c*)) while maintaining the air gap between the anchor 221*a* and 221*b* and the corresponding solenoid core.

Figure 10A:
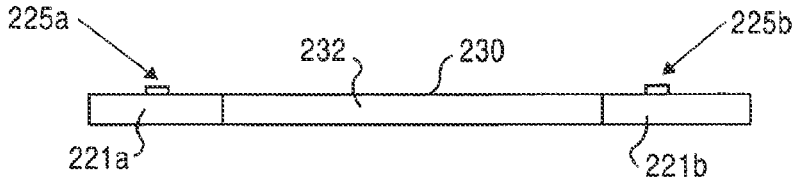
FIG. 10(*a*) is a schematic diagram of a top view illustrating the relationship between the actuating mechanism and the horizontal member of the locking bar when rotation of the locking bar and keeper is to be prevented.
Figure 10B:
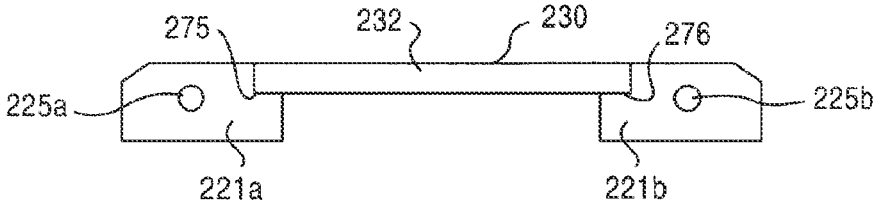
Figure 10C:
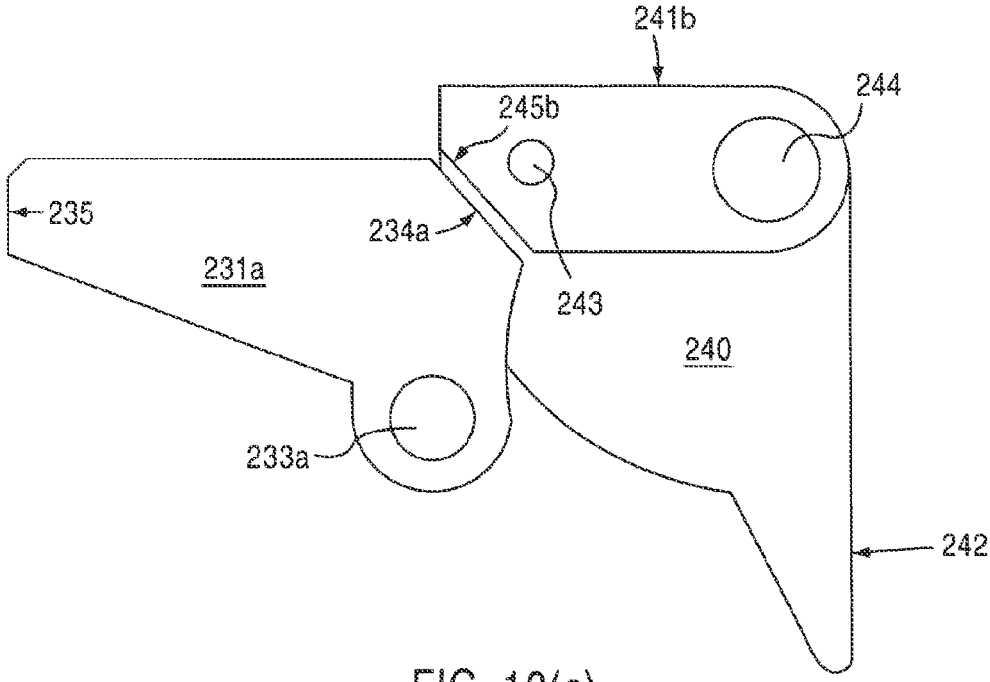

Turning to FIG. 10(*a*), a schematic diagram is provided showing a plan view of the anchors 221*a* and 221*b* supporting the member 232 of the locking bar 230 when the thrust mechanisms are in a first state, such as a non-energized state. FIG. 10(*b*) is a schematic diagram showing a front view of the anchors 221*a* and 221*b* supporting the member 232 on a shelf 275 and 276 formed respectively therein. FIG. 10(*c*) illustrates a side view of the locking bar 230 and keeper 240 in the first state. As such, the rear blocking face 234*a* of the locking bar 230 opposes the front blocking face 245*b* of the keeper 240.

Figure 11:
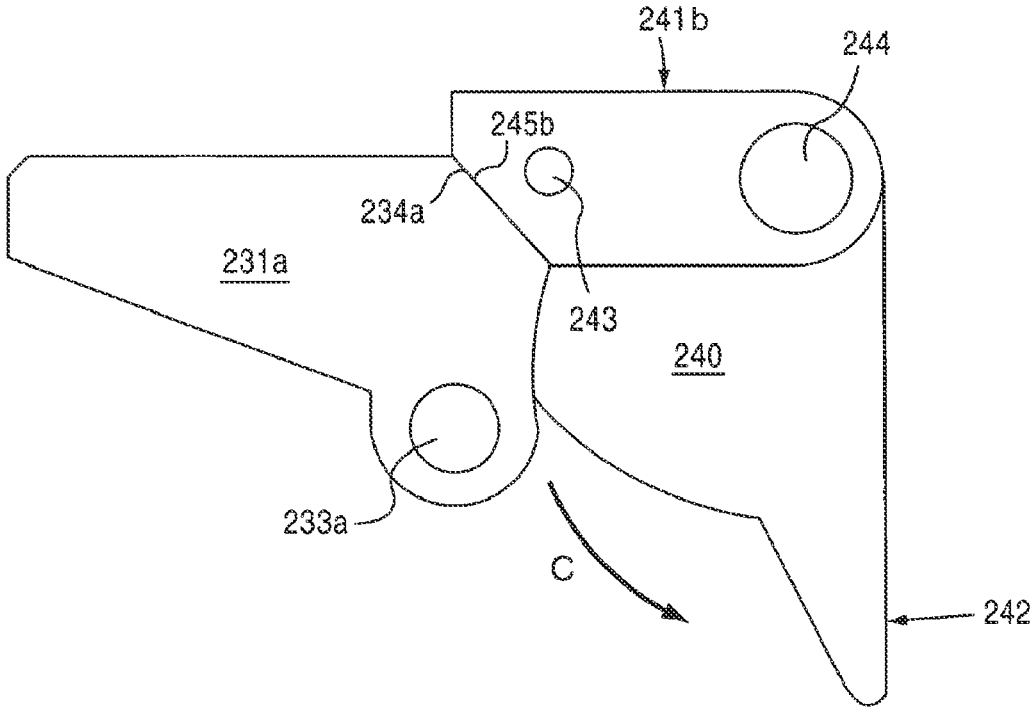
FIG. 11 is a side view illustrating the blocking faces of the locking bar and keeper engaging each other to prevent rotation thereof.

Therefore, if an attempt is made to open the door in which the rim strike 200 is mounted while in the first state, the keeper 240 will rotate slightly about the axial shaft 250 in a counterclockwise direction indicated by the arrow C (See FIG. 11). However, because the locking bar 230 is in the first state, that is, the locking bar 230 is prevented from rotating in a clockwise direction by the anchors 221*a* and 221*b*, the front blocking face 245*b* of the keeper 240 engages the rear blocking face 234*a* of the locking bar 230 and is prevented from any further counterclockwise rotation therethrough.

Figure 12A:
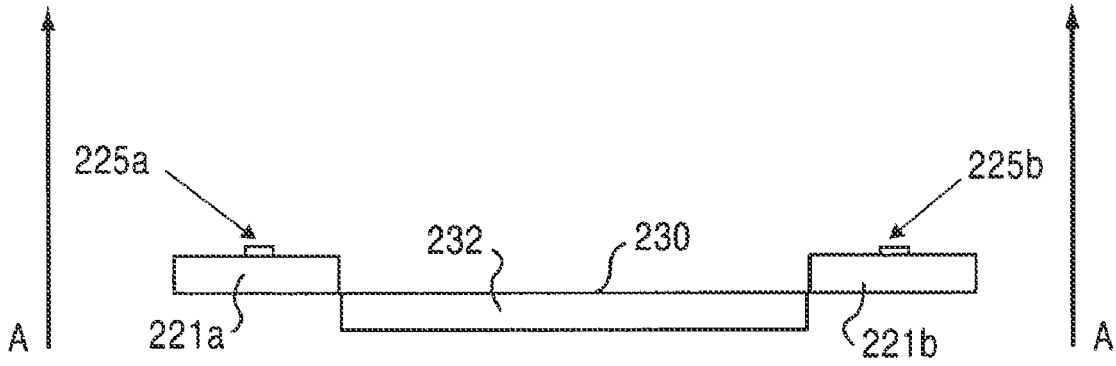
FIG. 12(*a*) is a schematic diagram of a top view illustrating the relationship between the actuating mechanism and the horizontal member of the locking bar when rotation of the locking bar and keeper is to be permitted.
Figure 12B:
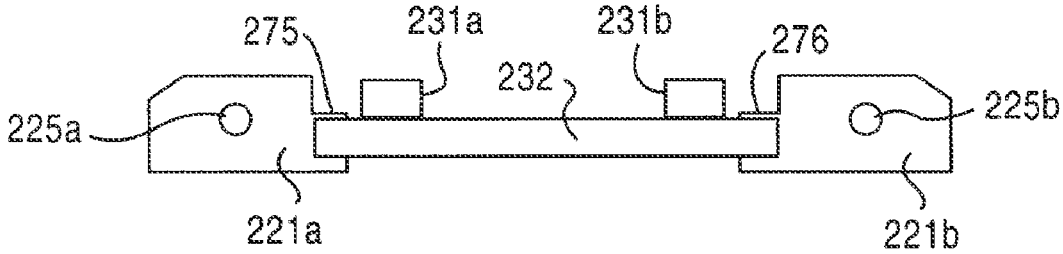
Figure 12C:
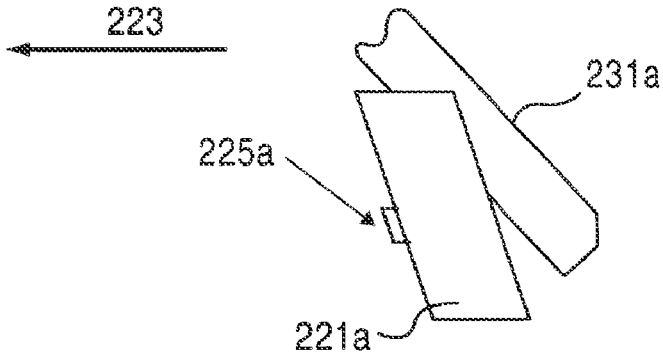

In a second state, that is, for example, wherein the thrust mechanisms or 220*a* and 220*b* are energized, the anchors 221*a* and 221*b* are driven to pivotally rotate in a direction indicated by the arrows A (See FIGS. 4 and 12(*a*)). That is, the member 232 is released from the shelves 275 and 276 of the respective anchors 221*a* and 221*b* and is able to rotatably disengage therefrom (See FIGS. 12(*b* and *c*)). Such disengagement may be encouraged, for example, by a biasing mechanism, such as a spring.

Figure 13:
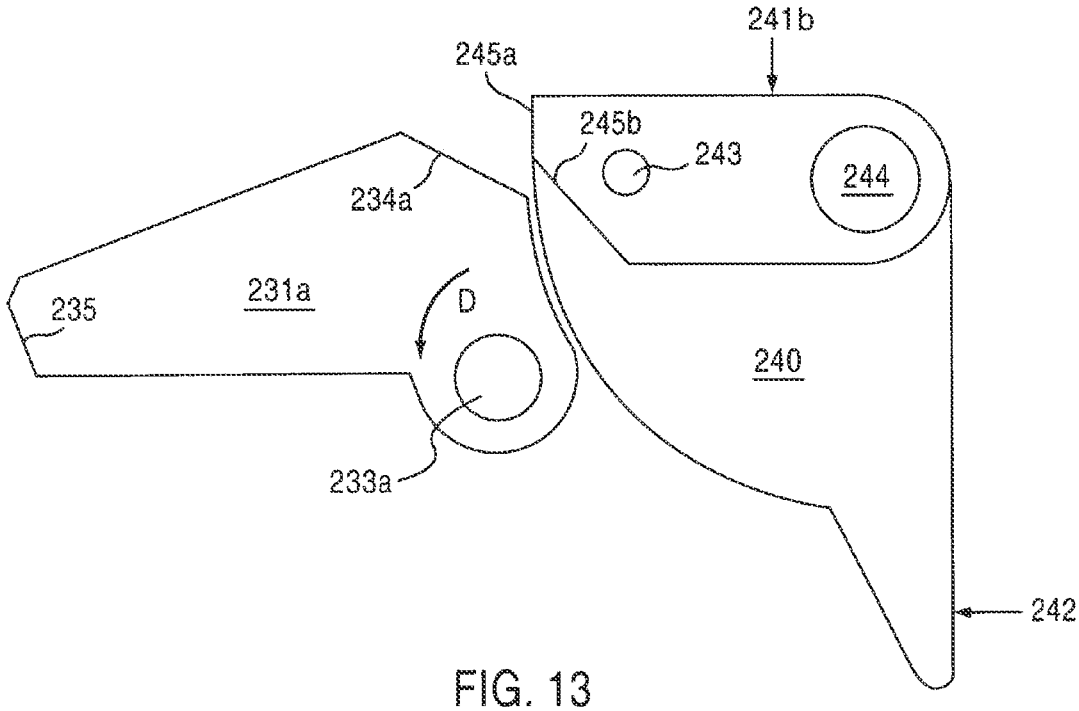
FIG. 13 is a side view illustrating the locking bar rotatingly pivoting relative to the keeper.
Figure 14:
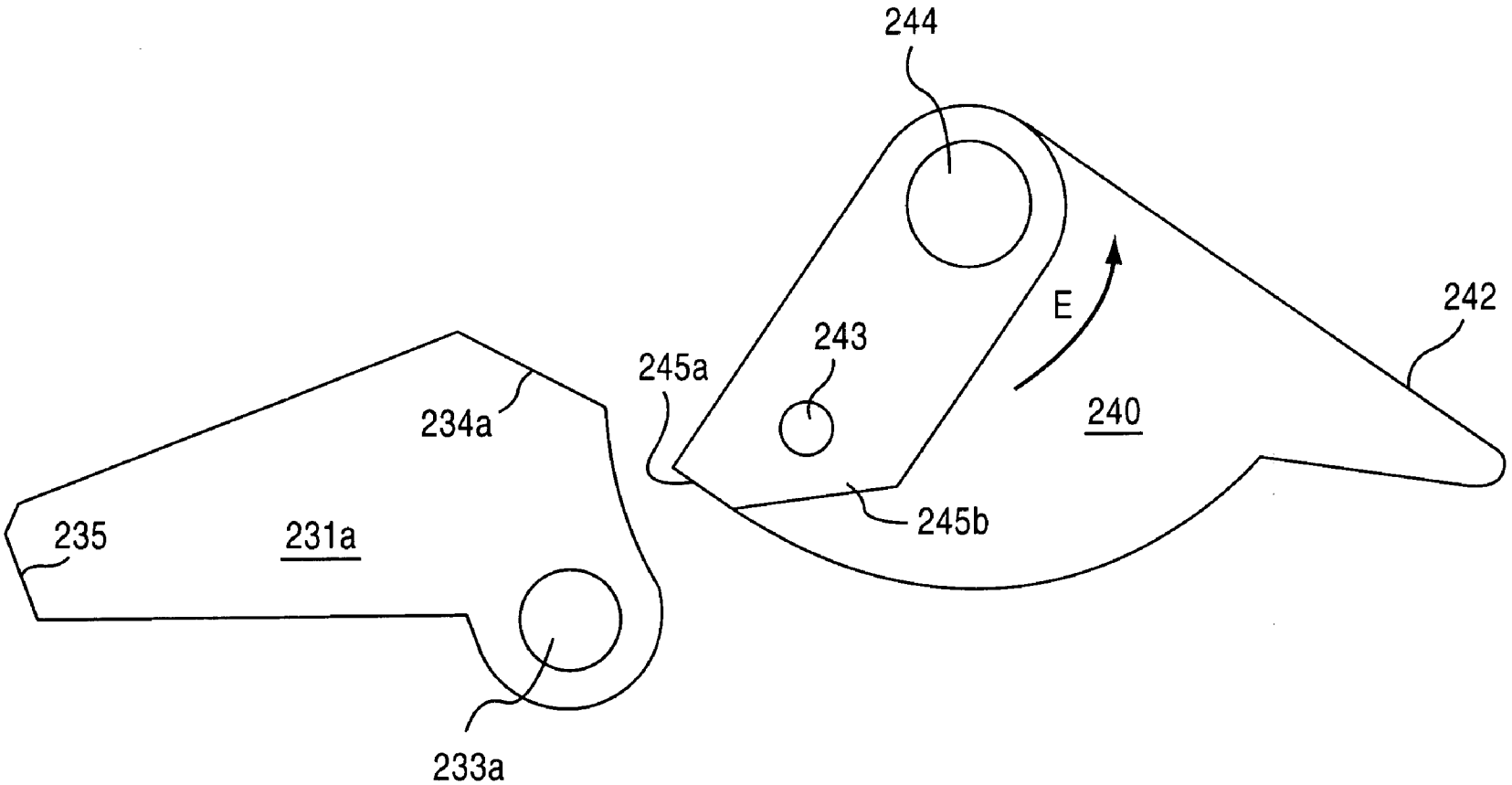
FIG. 14 is a side view illustrating the locking bar and keeper freely rotating relative to each other.

FIG. 13 shows the rear blocking face 234*a* of the locking bar 230 rotating away from the front blocking face 245*b* of the keeper 240. Accordingly, because the locking bar 230 is now in the second state, that is, the locking bar 230 is not prevented from rotating in a clockwise direction by the anchors 221*a* and 221*b*, the front blocking face 245*b* of the keeper 240 does not engage the rear blocking face 234*a* of the locking bar 230. As such, the keeper 240 is free to continue rotating in the counterclockwise direction, as indicated by the arrow D, and the door in which the rim strike 200 is mounted will open since the keeper 240 will thereby not hold a received door bolt.

As is clear from above, the abutting blocking faces 234*a* and 245*b* of the locking bar 230 and keeper 240, respectively, prevent the locking bar 230 and 240 from freely rotating relative to each other. However, when the solenoids 220*a* and 220*b* are energized, the locking bar 230 and keeper 240 are able to freely rotate away from each other, which allows the door to open. Then, the biasing member 249 mounted about the dowel 243*a* biases the keeper 240 to rotate clockwise back into the first state, where the keeper 240 is locking secured by the locking bar 230 until the process is repeated. Similarly, a biasing member (not shown) of the locking bar 230 biases the locking bar 230 to rotate counterclockwise back into the first state, where the locking bar 230 abuttingly engages the keeper 240. That is, the locking bar 230 and keeper 240 rotate back into place, and the keeper 240 is prevented from freely rotating until the solenoids 220*a* and 220*b* are again energized.

The above-described embodiments of the present invention are associated with an electric rim strike that operates in a fail-secure mode. However, those of ordinary skill in the art will understand that the configuration depicted in FIGS. 1-14 readily may be altered such that the electric rim strike is configured to operate in a fail-safe mode.

For example, the above provided description of the rim strike 200 provides for the locking bar 230 and keeper 240 to be in a locked mode when in the first state and a free to rotate mode when in the second state. However, it is within the scope of the invention to reverse the first and second states. In other words, rather than being locked in the first state, the locking bar 230 and keeper 240 may be free to rotate in the first state, that is, the solenoids 220*a* and 220*b* are constantly in an energized state to arrive at the situation illustrated in FIGS. 11(*a*) through 14 wherein the door is continuously unlocked. Then, when the door is desired to be locked, the power source ceases to energize the solenoids 220*a* and 220*b*, wherein the biasing member 243*a* biases the keeper 240 into the arrangement illustrated in FIGS. 10(*c*) and 11, wherein the locking bar 230 and keeper 240 cannot freely rotate relative to each other.

Although not intended to limit the invention in any manner, the above described scenario wherein the first state represents the locking bar 230 and keeper 240 not being able to freely rotate and the second state wherein the locking bar 230 and keeper 240 are free to rotate, is preferred for when the first state is set for when the door in which the rim strike 200 is mounted is closed or locked and the second state is for when the door is desired to be opened or unlocked. Such an arrangement is representative of normal use so that a constant stream of power from the power source is not being provided to the solenoids 220*a* and 220*b*. However, when the opposite arrangement is established, that is, the power source constantly provides power such that the solenoids 220*a* and 220*b* are continuously energized, the first state would be wherein the locking bar 230 and keeper 240 are constantly able to rotate freely relative to each other and the second state would be where the power source stops providing power wherein the solenoids 220*a* and 220*b* are not energized and the locking bar 230 and keeper 240 are locked and prevented from rotating relative to each other. Such an arrangement is envisioned for situations where the rim strike 200 is mounted in a door that must remain unlocked during specific times, such as during a fire so that people may freely pass therethrough en route to safety.

It should be noted that the rim strike 200 is configured such that the solenoids 220*a* and 220*b* can be energized with as little as 12 of 24 volts, for example. As such, it is within the scope of the invention for the power source to be a 12 volt battery, for example.

While the present invention has been described in connection with preferred embodiments, it will be understood by those skilled in the art that variations and modifications of the preferred embodiments described above may be made without departing from the scope of the invention. Other embodiments will be apparent to those skilled in the art from a consideration of the specification or from a practice of the invention disclosed herein. It is intended that the specification and the described examples are considered exemplary only, with the true scope of the invention indicated by the following claims.

What is claimed is:

1. An electric rim strike surface mountable on a door frame, comprising:

a pivotally-rotatable keeper, including:

a first member having two ends, each end including a front inclined blocking face, and a second member extending orthogonally from the first member;

a pivotally-rotatable locking bar including two extension arms, each extension arm having a rear inclined blocking face to engage a respective front blocking face of the keeper;

a thrust mechanism; and an anchor including a spacer, wherein, when the thrust mechanism is de-energized, the anchor engages the locking bar to prevent the locking bar from rotating, and the rear blocking faces engage the respective front blocking faces to prevent the keeper from rotating, and when the thrust mechanism is energized, the anchor is driven towards the thrust mechanism, the spacer maintains an air gap between the anchor and the thrust mechanism, the anchor disengages from the locking bar to allow the locking bar to rotate, and the rear blocking faces disengage from the respective front blocking faces to allow the keeper to rotate.

2. The rim strike according to claim 1, wherein the locking bar includes a member disposed between the two extension arms and at least one shelf to engage the anchor.

3. The rim strike according to claim 1, wherein the locking bar pivots about a first pivoting mechanism and the keeper pivots about a second pivoting mechanism.

4. The rim strike according to claim 3, wherein the first and the second pivoting mechanisms are an axial shaft or a pin.

5. The rim strike according to claim 1, wherein the locking bar includes a member, disposed between the two extension arms, having a front face, wherein the rear blocking faces are obliquely disposed relative to the front face.

6. The rim strike according to claim 1, further comprising:

a first biasing member urging the anchor to a respective predetermined state; and a second biasing member urging the keeper to a respective predetermined state.

7. The rim strike according to claim 6, wherein the first and second biasing members are springs.

8. The rim strike according to claim 1, wherein the thrust mechanism is a solenoid.

9. An electric rim strike surface mountable on a door frame, comprising:

a housing having a cavity defined therein;

a pivotally-rotatable keeper, including:

a first member having two ends, each end including a front inclined blocking face, and a second member extending orthogonally from the first member;

a pivotally-rotatable locking bar including two extension arms and a member disposed therebetween, each extension arm having a rear inclined blocking face; and two solenoids; and two anchors, each including a spacer, wherein, when the solenoids are de-energized, each anchor engages the locking bar to prevent the locking bar from rotating, and each locking bar blocking face engages a respective keeper blocking face to prevent the keeper from rotating, and when the solenoids are energized, each anchor is driven towards a respective solenoid, each spacer maintains an air gap between the anchor and the respective solenoid, each anchor disengages from the locking bar to allow the locking bar to rotate, and each locking bar blocking face disengages from the respective keeper blocking face to allow the keeper to rotate.

10. The rim strike according to claim 9, wherein the locking bar member includes two shelves to respectively engage the anchors.

11. The rim strike according to claim 9, wherein the keeper, the locking bar, and the solenoids are disposed within the cavity of the housing.

12. The rim strike according to claim 9, wherein the solenoids have an energized state and a non-energized state.

13. The rim strike according to claim 9, wherein the locking bar pivots about a first pivoting mechanism connected to the housing, and the keeper pivots about a second pivoting mechanism connected to the housing.

14. The rim strike according to claim 13, wherein the first and second pivoting mechanisms are one of an axial shaft and a pin.

15. The rim strike according to claim 1, wherein the anchor is pivotally-rotatable.

16. The rim strike according to claim 1, wherein each end of the keeper includes a front face connected to the font inclined blocking face.

17. The rim strike according to claim 8, wherein the spacer is manufactured from a non-magnetic material.

18. The rim strike according to claim 9, wherein each end of the keeper includes a front face connected to the front inclined blocking face.

19. The rim strike according to claim 9, wherein the spacers are manufactured from a non-magnetic material.

20. An electric rim strike surface mountable on a door frame, comprising:

a pivotally-rotatable keeper, including:

a first member having two ends, each end including a front inclined blocking face, and a second member extending orthogonally from the first member;

a pivotally-rotatable locking bar including two extension arms, each extension arm having a rear inclined blocking face to engage a respective front blocking face of the keeper;

a thrust mechanism; and an anchor including a spacer, wherein, when the thrust mechanism is de-energized, the spacer maintains an air gap between the anchor and the thrust mechanism, the anchor disengages from the locking bar to allow the locking bar to rotate, and the rear blocking faces disengage from the respective front blocking faces to allow the keeper to rotate, and when the thrust mechanism is energized, the anchor is driven away from the thrust mechanism, the anchor engages the locking bar to prevent the locking bar from rotating, and the rear blocking faces engage the respective front blocking faces to prevent the keeper from rotating.

21. An electric rim strike surface mountable on a door frame, comprising:

a housing having a cavity defined therein;

a pivotally-rotatable keeper, including:

a first member having two ends, each end including a front inclined blocking face, and a second member extending orthogonally from the first member;

a pivotally-rotatable locking bar including two extension arms and a member disposed therebetween, each extension arm having a rear inclined blocking face; and two solenoids; and two anchors, each anchor including a spacer, wherein, when the solenoids are de-energized, each spacer maintains an air gap between the anchor and the respective solenoid, each anchor disengages from the locking bar to allow the locking bar to rotate, and each locking bar blocking face disengages from the respective keeper blocking face to allow the keeper to rotate, and when the solenoids are energized, each anchor is driven away from a respective solenoid, each anchor engages the locking bar to prevent the locking bar from rotating, and each locking bar blocking face engages a respective keeper blocking face to prevent the keeper from rotating.

* * * * *